United States Patent [19]

Engler et al.

[11] Patent Number: 4,763,800

[45] Date of Patent: Aug. 16, 1988

[54] MOBILE LIFTING APPARATUS

[75] Inventors: Edgar D. Engler, 1818 Hickory St., South Milwaukee, Wis. 53172; Gus J. Weber, Hinsdale, Ill.; Melvin G. Stapel, Brookfield, Wis.; John J. Mlaker; Leonard Hanson, both of Milwaukee, Wis.

[73] Assignee: Edgar D. Engler, South Milwaukee, Wis.

[21] Appl. No.: 848,448

[22] Filed: Mar. 19, 1986

[51] Int. Cl.[4] ..... B66C 23/72

[52] U.S. Cl. ..... 212/195; 212/218

[58] Field of Search ..... 212/205–221, 212/156, 195; 414/460, 461, 560, 561

[56] References Cited

U.S. PATENT DOCUMENTS

| | | | |
|---|---|---|---|
| 2,130,487 | 9/1938 | Foley . | |
| 2,368,268 | 1/1945 | Spiegel . | |
| 2,916,172 | 12/1959 | Locke | 212/156 |
| 3,081,883 | 3/1963 | Minty | 212/219 |
| 3,547,278 | 12/1970 | Tayler . | |
| 3,642,148 | 2/1972 | Durand | 212/156 |
| 3,851,776 | 12/1974 | Layrat . | |
| 4,502,569 | 3/1985 | Loechner | 212/208 |
| 4,573,853 | 3/1986 | Lorenz | 212/208 |

*Primary Examiner*—Joseph F. Peters, Jr.
*Assistant Examiner*—Stephen P. Avila
*Attorney, Agent, or Firm*—Andrus, Sceales, Starke & Sawall

[57] ABSTRACT

A mobile lifting apparatus has a chassis with front driving wheels and steerable rear wheels. A vertical mast comprised of a pair of extendible hydraulic cylinders is spacedly mounted on the front of the chassis. One or more jam stay cylinders are mounted on the chassis rearwardly of the vertical mast. A pair of extendable booms are mounted on the vertical mast and jam stay cylinders. The load may be attached to the end of the booms. A hydraulic or other power supply extends and retracts the boom and drives the driving wheels. A counterweight is mounted on the rear of the chassis and the chassis may be extended to increase the capacity and stability of the lifting apparatus.

39 Claims, 8 Drawing Sheets

MOBILE LIFTING APPARATUS

The present invention relates to mobile lifting apparatus or a boom truck including a pair of booms and a pair of vertical lifting columns mounted on a self-propelled vehicle. The apparatus may move about the work area, both with and without a load.

It is necessary to lift loads, such as machinery, to install, remove, or reposition same. Such loads may be typified by metal or plastic forming and cutting machinery as used in automotive and other industries. These machines may weight up to several hundred tons.

One type of apparatus that may be used to lift such loads is termed a gantry. Such a gantry is shown in U.S. Pat. No. 4,381,839. While the load can be lifted with a gantry it may be difficult and/or awkward to move the load once it is lifted.

Some machinery lifting and moving applications may be served by altering material handling equipment, such as fork lift trucks. The forks are removed and a stationary framework applied to the front of the vehicle to engage the load.

However, such modifications are limited in capacity and tend to be unsatisfactory from the mechanical standpoint, as well as possibly dangerous to the fork lift truck operator and other workers. The limited capacity of altered material handling equipment may require the user of several fork lift trucks to lift the load.

It is therefore the object of the present invention to provide a lifting apparatus which has sufficient lift capacity for loads of the type described above while, at the same time is both highly mobile and compact. This permits the apparatus to be quickly, easily, and economically brought to and removed from the work site. It also facilitates moving the load once it is lifted.

Briefly, the present invention contemplates a mobile lifting apparatus or boom truck having a chassis with driving wheels for propelling it and steerable wheels for steering it. The driving wheels may be mounted on the front of the chassis and the steerable wheels at the rear. A vertical mast means, preferably comprising a spaced pair of telescopically extendible hydraulic cylinders is mounted on the front of the chassis. Jam stay means, such as one or more telescopically extendible hydraulic cylinders, is mounted on the chassis rearwardly of the vertical mast. A boom means having a spaced pair of base members containing extendible telescopic booms is mounted on top of the vertical mast means and the jam stay means. The ends of the spaced extendible booms include means for engaging the load. A power means raises and lowers the vertical mast and jam stay means, extends and retracts the booms, and powers the driving wheels. The power means may comprise an electrically operated hydraulic power means.

The driving wheels preferably comprise at least two pairs of wheels having means for selectively driving one or both of the wheels of each pair depending on the load conditions of the mobile lifting apparatus. An idler wheel may be provided between the selectively drivable wheels of each pair.

The steerable wheels are mounted in the rear of the chassis in pods journalled in annular bearings. Two such pods may be provided, each of which is rotated by a linear motor means, such as a hydraulic cylinder. A tie rod extends between the steerable wheel pods to coordinate their rotation.

The chassis may have telescoping side members that serve to increase and reduce the wheel base of the chassis. A modular counterweight is mounted on the extendible portion of the chassis. The capacity and stability of the mobile lifting apparatus may thus be controlled and increased.

The present invention will be further understood by reference to the following detailed description taken in conjunction with the drawing in which.

Figure 1:
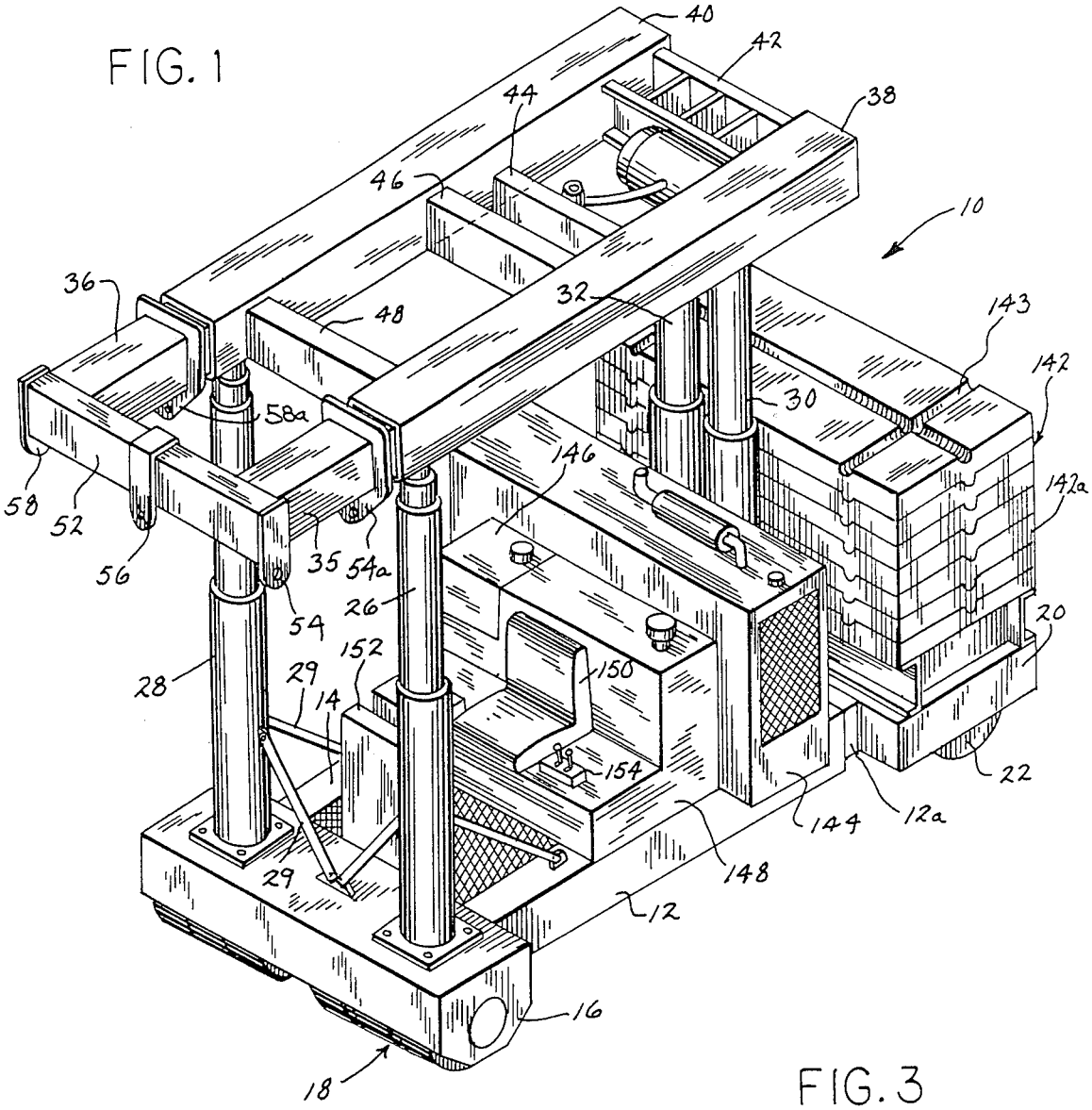
FIG. 1 is a perspective view of the mobile lifting apparatus of the present invention.

Mobile lifting apparatus 10 shown in FIG. 1 has a chassis including a pair of said frames 12 and 14, a front transverse member 16 containing driving wheels 18, and a rear transverse member 20 containing steerable wheels 22.

Figure 2:
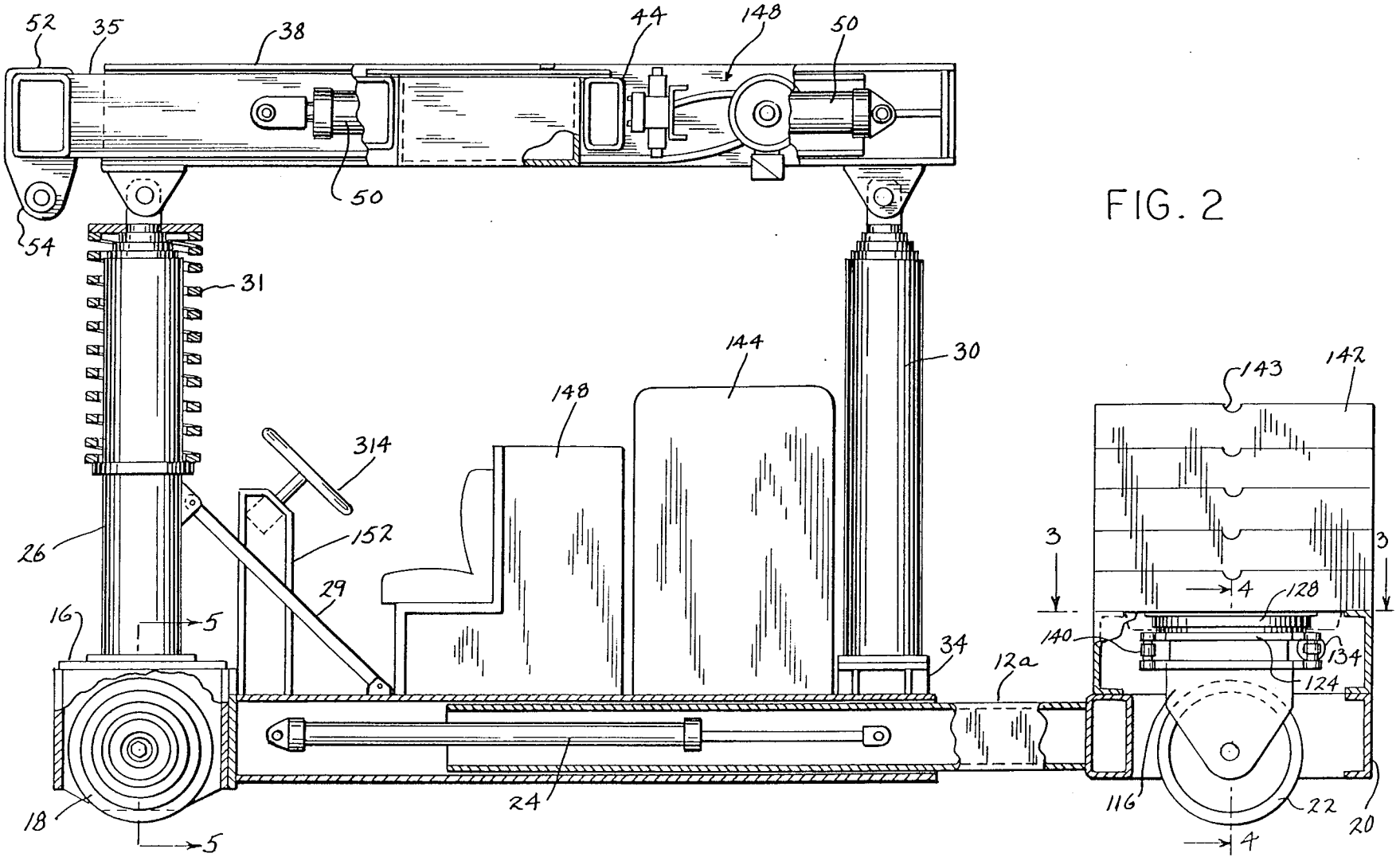
FIG. 2 is a side view, partially in section, of the apparatus.

As shown most clearly in FIG. 2, each of said frames 12 and 14 include telescopic members, one of which is shown as 12*a*. One end of hydraulic cylinder 24 is fastened to frame 12. The other end is fastened to telescopic member 12*a*. Member 12*a* may be extended by a hydraulic cylinder 24 to increase the wheel base of mobile lifting apparatus 10, and retracted to reduce it. A corresponding telescopic member and hydraulic cylinder is provided for frame 14. Other mechanisms, such as a pneumatic cylinder, a lead screw and nut, and a rack and pinion may be used to extend and retract member 12*a* and the corresponding member in frame 14.

A pair of spaced, vertical lifting columns 26 and 28 are mounted on front transverse member 16 to form a vertical mast. Columns 26 and 28 may be located on front transverse member 16, so as to be generally in alignment with frames 12 and 14. Columns 26 and 28 may comprise single or double acting, telescoping, multistage hydraulic cylinders and are typically designed with a safety factor of 2:1. Columns 26 and 28 are infinitely adjustable within their operating range. Braces 29 are provided for columns 26 and 28, as are protective shields. The protective shields may take the form of helical bumpers 31 formed of rubber or plastic, as shown in FIG. 2.

One or more vertical hydraulic columns 30 and 32 are mounted on transverse member 34 extending between frames 12 and 14 to comprise a jam stay means. Transverse member 34 is shown in FIG. 2. Two columns 30 and 32 closely spaced together in the central portion of transverse member 34, as shown in FIG. 1, are preferably employed in the mobile lifting apparatus of the present invention as the size of a single column would be awkward from the manufacturing and assembly standpoint. Vertical lifting columns 26 and 28 and jam stay means 30–32 form a basically triangular lifting arrangement. Columns 30 and 32 may be formed of double acting, telescoping, multi-stage hydraulic cylinders. The cylinders of columns 30 and 32 may have a larger piston area than the cylinders of columns 36 and 28 to insure that a downward holding force can be achieved.

A pair of telescoping booms 35 and 36 are mounted on top of columns 26 and 28 and columns 30 and 32. Each boom 35, 36 is received in a hollow base member 38 and 40, respectively. Base members 38 and 40 are pivotally joined to the tops of hydraulic columns 26 and 28, respectively. Transverse member 42 extends between the rear ends of boom base members 38 and 40 and is pivotally joined to closely spaced columns 30 and 32. Additional transverse members 44, 46, and 48 extend between boom base members 38 and 40.

A hydraulic cylinder, such as that shown in FIG. 2 as 50 is mounted in each of the booms and the boom base members to permit extension and retraction of the booms. Appropriate slides may be provided the base member and booms to permit the booms to extend and retract under load.

Transverse member 52 extends between the ends of booms 35 and 36 and contains a plurality of spaced rigging points 54, 56 and 58. Cables or other lifting devices for the load may be attached to rigging points 54, 56 and 58. The plurality of spaced rigging points provides a high degree of stability to the mobile lifting apparatus of the present invention, particularly as compared to single boom lifting devices. This permits mobile lifting apparatus 10 to typically operate without outriggers unless conditions such as excessively slanting floors are encountered. Also, with a single boom, the load must be rigged through the center of gravity whereas with the spaced, two boom design of the present invention, the center of gravity of the load can lie anywhere along the transverse distance between booms 35 and 36. Additional rigging points on booms 35 and 36 such as those shown by **54*a* and 58*a* in FIG. 1, may also be provided. Rigging points 54*a*, 58*a*** may slide along the booms so as to be adjustable in position.

As noted above, front wheels 18 mounted in front transverse member 16 are used to drive mobile lifting apparatus 10. Two sets, or pods of front wheels 18 are provided, one adjacent either end of front transverse member 16. One set of front wheels is shown in detail in FIG. 5. Front transverse member 16 has a top plate 60 to which the vertical mast is fastened. Outer end plate 62, and intermediate plates 64, 66 and 68, are parellel to end plate 62 and depend from plate 60. Cylinder 70 is journalled in plates 62, 64, and 66 by bearings 72, 74, and 76 to function as an axle or shaft. Cylinder 70 is rotated by motor 78 mounted on plate 68. Motor 78 includes brake 80. Motor 78 drives gear unit 82 that is connected to cylinder 70 by bolts 84.

Front wheel **18*a* is mounted to cylinder 70. Front wheel 18*a* includes frame 86 mounting tire 88. Motor 78 drives gear unit 82 that is connected to cylinder 70 by bolts 84**.

Front wheel **18*a* is mounted to cylinder 70. Front wheel 18*a* includes frame 86 mounting tire 88. Frame 86 is fastened to cylinder 70 by bolts 84. Front wheel 18*a* is thus driven by motor 78**.

Front wheel **18*b* is an idler wheel that serves to support the weight of mobile lifting apparatus 10 and the load carried by it. Bushings 90 surround cylinder 70 and extend between cylinder 70 and frame 92 of idler wheel 18*b* to permit relative rotation therebetween. Thrustwasher-spacers 93 lie on either side of idler wheel 18*b***.

Front wheel **18*c* is selectively drivable by motor 78. Thus, when mobile lifting apparatus 10 is unloaded, or lightly loaded, both wheels 18*a* and 18*c* of each pod may be driven by motor 78 to provide sufficient traction for the apparatus. When mobile lifting apparatus 10 is heavily loaded, driving a single wheel 18*a* of each pod is sufficient. Ring 94 of frame 96 of front wheel 18*c* is fastened to annulus 98 by screws 100. The inner surface of annulus 98 is conically tapered. Truncated conical member 102 is fastened to cylinder 70 by bolt 104 threaded in plate 106. When bolt 104 is tightened, conical member 102 is fastened to cylinder 70 by bolt 104 threaded in plate 106. When bolt 104 is tightened, conical member 102 engages annulus 98 to drive wheel 18*c*. When bolt 104 is loosened, wheel 18*c* can free-wheel. Thrustwasher-spacers 95 are provided on each side of wheel 18*c***.

It should be noted that the construction of the front wheel pod is such that only shear forces appear. This is in contrast to conventional stub axle arrangements in which bending moments also appear.

Figure 3:
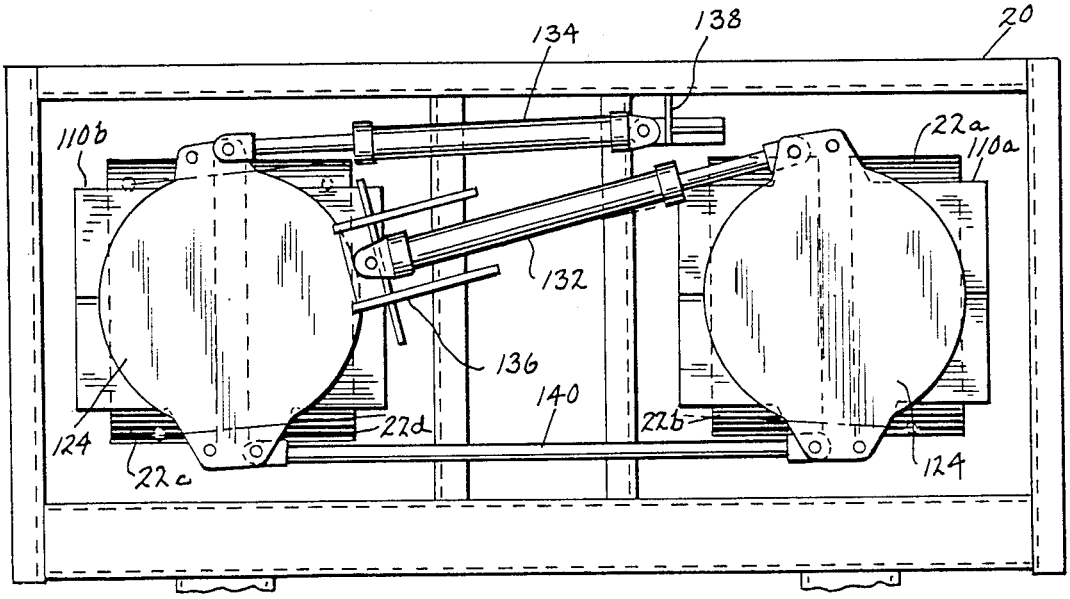
FIG. 3 is a partial cross-sectional view taken along the line 3—3 of FIG. 2 showing the steerable wheels of the lifting apparatus.
Figure 4:
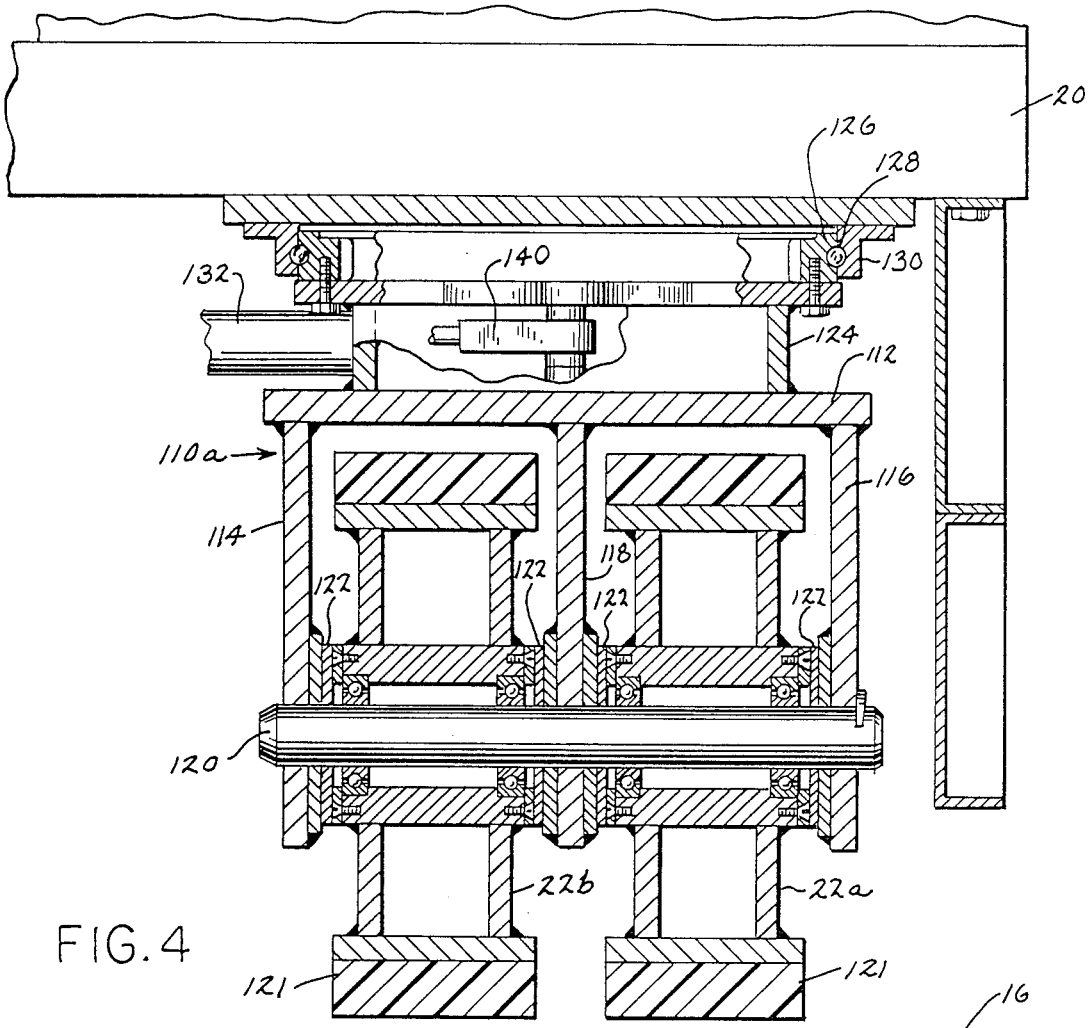
FIG. 4 is a partial cross-sectional view taken along the line 4—4 of FIG. 2 showing additional details of the steerable wheels.

Rear wheels 22, mounted in rear transverse member 20, are used to steer mobile lifting apparatus 10. The details of rear wheel 22 and rear transverse member 20 are shown in FIGS. 2, 3, and 4. As shown in FIG. 3, four rear wheels **22*a*, 22*b*, 22*c* and 22*d* may be utilized. The wheels may be mounted in pairs in pods 110*a* and 110*b*. Each pod comprises a top plate 112, a pair of depending end plates 114, 116 and central plate 118. Axle 120 extends through plates 114, 116 and 118. Wheels 22*a*, 22*b* having tires 121 are mounted on axle 120 through appropriate bearings. Thrustwasher-spacers 122 may be placed on axle 120** between the plates and wheels. As with the front wheel assembly, through the use of pods having the plates on either side of the wheels, the forces in the members are limited to mainly shear forces.

Pods **110*a* and 110*b* are mounted on rear transverse member 20 to rotate about vertical axes. For this purpose, spacer assembly 124 mounted on top plate 112 contains the inner race 126 of annular bearing 128. The outer race 130 of the bearing is fastened to rear transverse member 20. The diameter of bearing 128 may approximate the length of axle 120 to facilitate rotation of pods 110** and to stabilize the steering apparatus.

Pods **110*a* and 110*b* are rotated in bearings 128 by a linear motor means such as the pair of hydraulic cylinders 132, 134 shown in FIG. 3. Hydraulic cylinder 132 extends between spacer 124 of pod 110*a* and anchor 136 mounted on rear transverse member 20. Hydraulic cylinder 134 extends between spacer 124 of pod 110*b* and anchor 138 mounted on rear transverse member 20. Tie bar 140 connects the spacers of the two pods together to ensure coordinated rotation of the pods by cylinders 132 and 134**.

Tires 88 for front wheels 18 provide traction for boom truck 10 and distribute the weight of the truck and the load being lifted. For this purpose, the tires may be formed of a composite plastic or rubber material such as one including polyurethane. Tires 121 for rear wheels 22 may be similarly formed.

Counterweight 142 is mounted on top of rear transverse member 20 to counterbalance the load applied to booms 34 and 36. The counterweight may be modular in construction and formed of a plurality of weights **142*a*. Weights 142*a* may be formed with a tongue and groove key 143 to maintain the individual weights in position. Through the modular construction, no more weight need be provided than is necessary to accommodate the anticipated load to be applied to mobile lifting apparatus 10. This facilitates trucking of the mobile lifting apparatus to the job site. Also, side members 12***a* may be extended to increase the mechanical effectiveness of counterweight 142.

Mobile lifting apparatus 10 may be provided with a prime power supply 144, including a gas, propane, or diesel engine. The prime power supply engine may drive one or more electric generators and hydraulic fluid pumps, shown in FIG. 6. Tank 146 is provided for hydraulic fluid. The driver's seat 150 may sit on fuel tank 148 behind steering pedestal 152. The controls 154 for operating mobile lifting apparatus may be provided on the pedestal, or adjacent seat 150. It will be appreciated that the operator has a relatively clear field of vision to view the work area, particularly as contrasted to prior art devices, such as modified fork lift trucks, in which the operator's vision is blocked by the lift and associated equipment.

Auxiliary equipment, such as winches and the like may be mounted on booms 35–36, the mobile lifting apparatus chassis, or counter weight 142 to assist in the operation of the apparatus, if desired.

Figure 5:
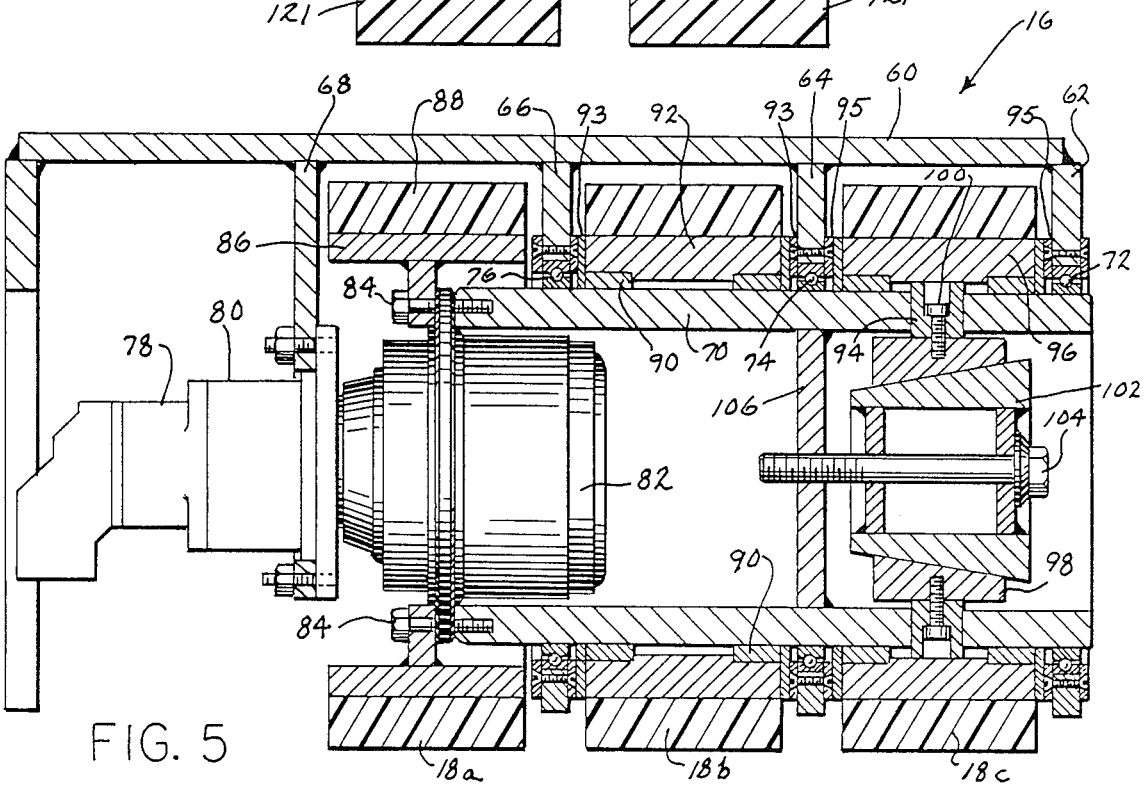
FIG. 5 is a partial cross-sectional view taken along the line 5—5 of FIG. 2 showing the driving wheels of the mobile lifting apparatus.
Figure 6A:
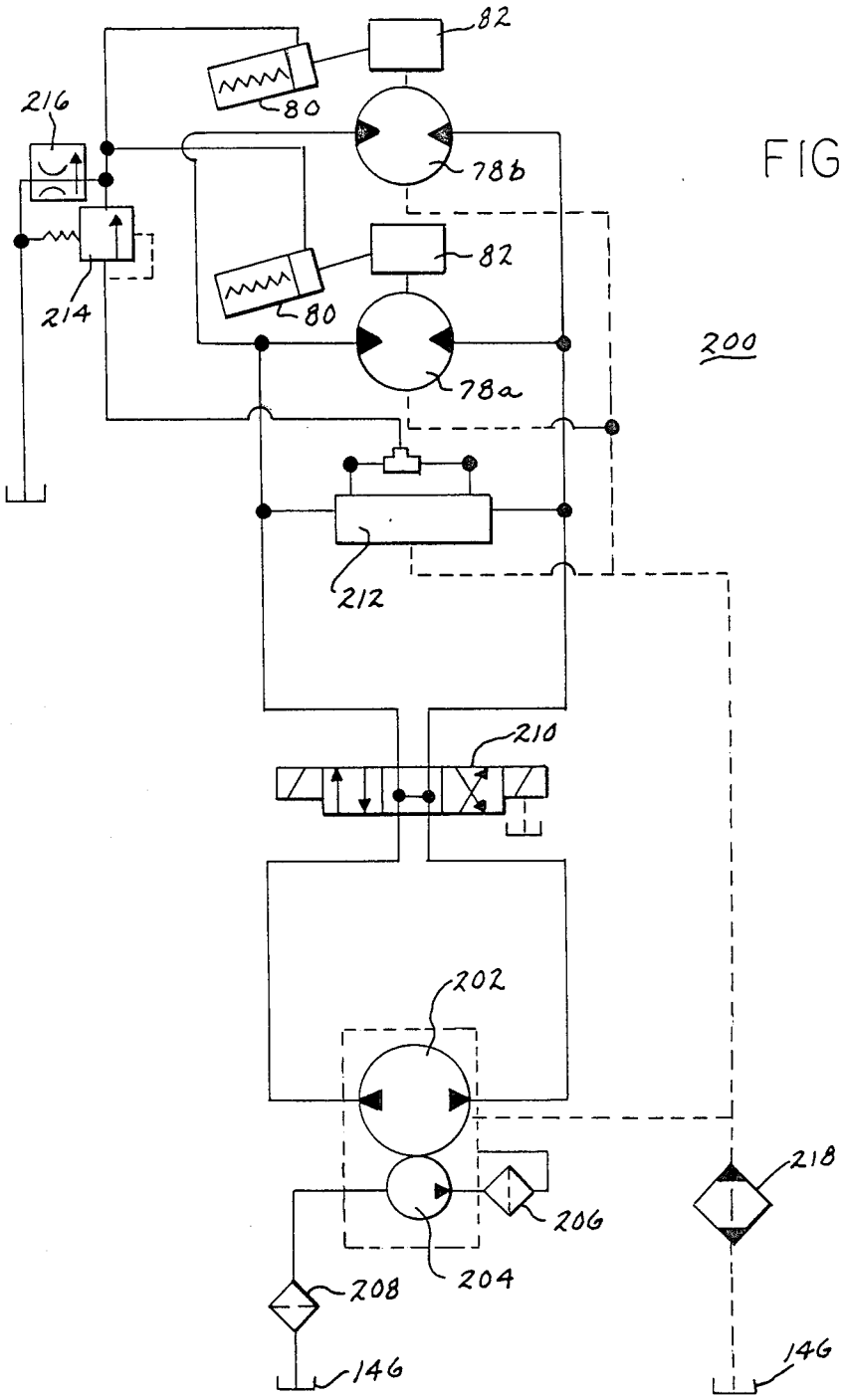
FIGS. 6A through 6D are schematic diagrams of hydraulic circuitry for the mobile lifting apparatus.

An hydraulic circuit suitable for use in mobile lifting apparatus 10 is shown in FIG. 6A through 6D. FIG. 6A shows a circuitry 200 thay may be used to drive front propulsion wheels 18. Circuit 200 includes reversable hydraulic fluid pump 202 driven by prime power supply 144 and supplied with hydraulic fluid from tank 146 through auxiliary pump 204 and filters 206 and 208. The output of pump 202 is connected through four-way three-position solenoid operated control valve 210 to reversible hydraulic motors 78*a* and 78*b*. One hydraulic motor 78*a* is mounted in one of the front wheel pods and the other hydraulic motor 78*b* is mounted in the other front wheel pod. Motors 78*a* and 78*b* are connected to propulsion wheels 18 thorugh gear units 82, as shown in FIG. 5. The use of two hydraulic motors, one for each pod, connected in parallel to hydraulic fluid pump obtains differential movement of the driving wheels when mobile lifting apparatus 10 turns. A pressure relief means 212 is connected across motors 78*a* and 78*b*. The relief flow from means 212 and motors 78*a* and 78*b* is returned through heat exchanger 218.

Fail safe brakes 80 are mounted to gear units 82 and are operable through pressure reducing valve 214 and proportional control valve 216 for braking propulsion wheels 18.

Figure 6B:
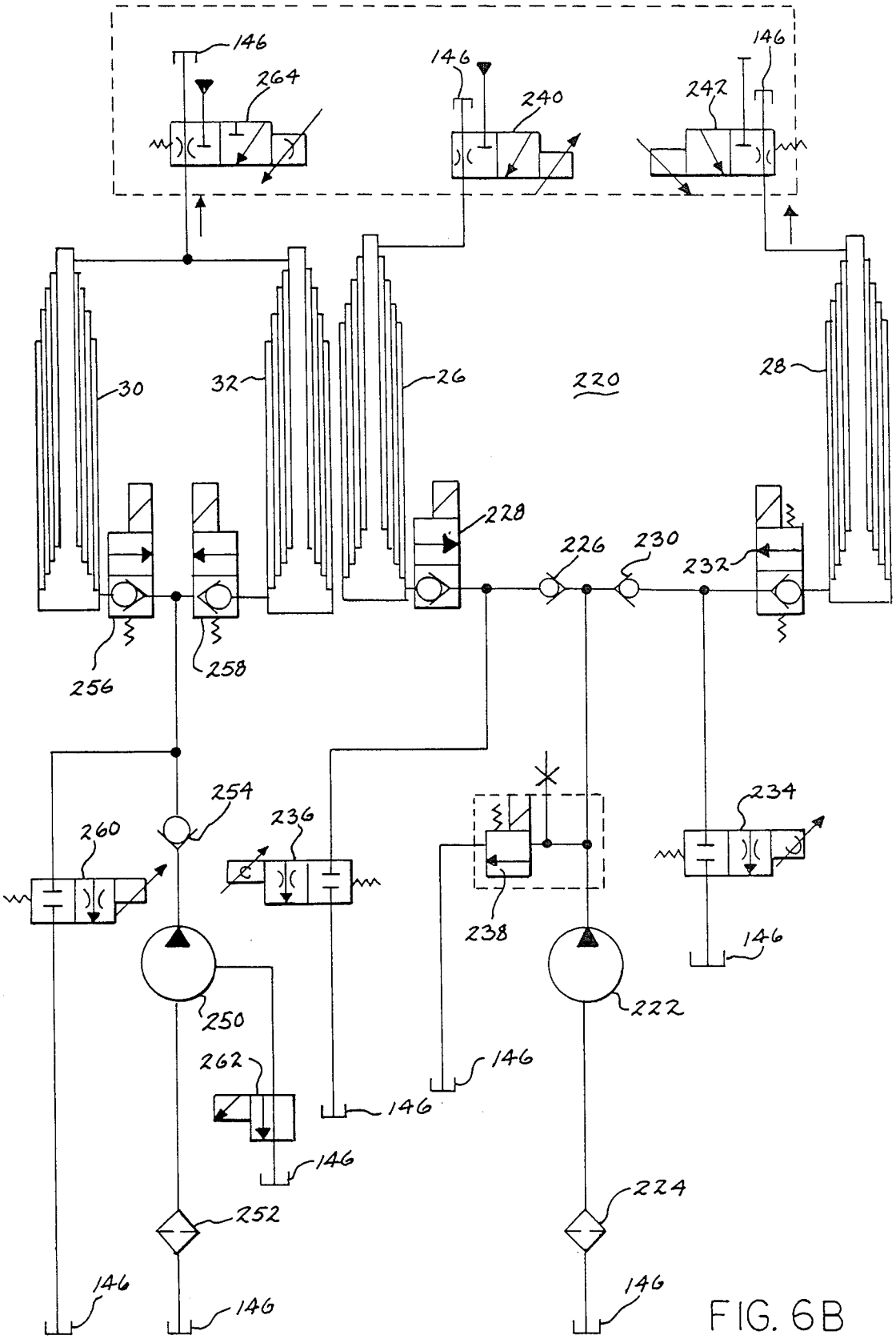

FIG. 6B shows a hydraulic circuit 220 suitable for operating vertical lifting columns 26 and 28 and vertical hydraulic columns 30 and 32. The hydraulic circuitry for vertical lifting columns 26 and 28 includes hydraulic pump 222 driven by prime power supply 144 and supplied with hydraulic fluid from tank 146 through filter 224. The output of hydraulic pump 222 is provided through check valve 226 and solenoid operated two-way control valve 228 to the extend port in the base of vertical lifting column 26. The output of pump 222 is provided through check valve 230 and solenoid operated two-way control valve 232 to the extend port in the base of vertical lifting column 28. Solenoid operated proportional control valve 234 is connected between check valve 230 and control valve 232. Valve 234 discharges to reservoir 146. Solenoid operated proportional control valve 236 is connected in the hydraulic line between check valve 226 and control valve 228. Valve 236 also discharges to tank 146. Solenoid operated relief valve 238 connected to the output of pump 222 and to reservoir 146 establishes the hydraulic pressure in the circuit.

At the upper end of vertical lifting columns 26 and 28, two-way proportional control valves 240 and 242 are connected to the retract port of the cylinders forming the columns, when the hydraulic cylinders are of the double acting type. In the position of the valve shown in FIG. 6B, the retract port is connected through the porportional control portion of the valve to tank 146. In the other position of solenoid operated proportioning valves 240 and 242, the retract port is connected to the source of hydraulic fluid. Valves 234 and 236 and the other proportional control valves in the hydraulic circuitry contain two operating solenoids: one to switch it between positions and one to control the proportioning action.

The hydraulic circuitry for vertical hydraulic columns 30 and 32 includes hydraulic pump 250 provided with hydraulic fluid from reservoir 146 through filter 252. The output of hydraulic pump 250 is provided through check valve 254 and solenoid operated control valves 256 and 258 to the extend ports in the bases of vertical hydraulic columns 30 and 32. Two way, solenoid operated proportional control valve 260 is connected intermediate check valve 254 and control valves 256, 258. Valve 260 is also connected to tank 146. Pressure relief valve 262 is connected between the output of pump 250 and tank 146.

Figure 6C:
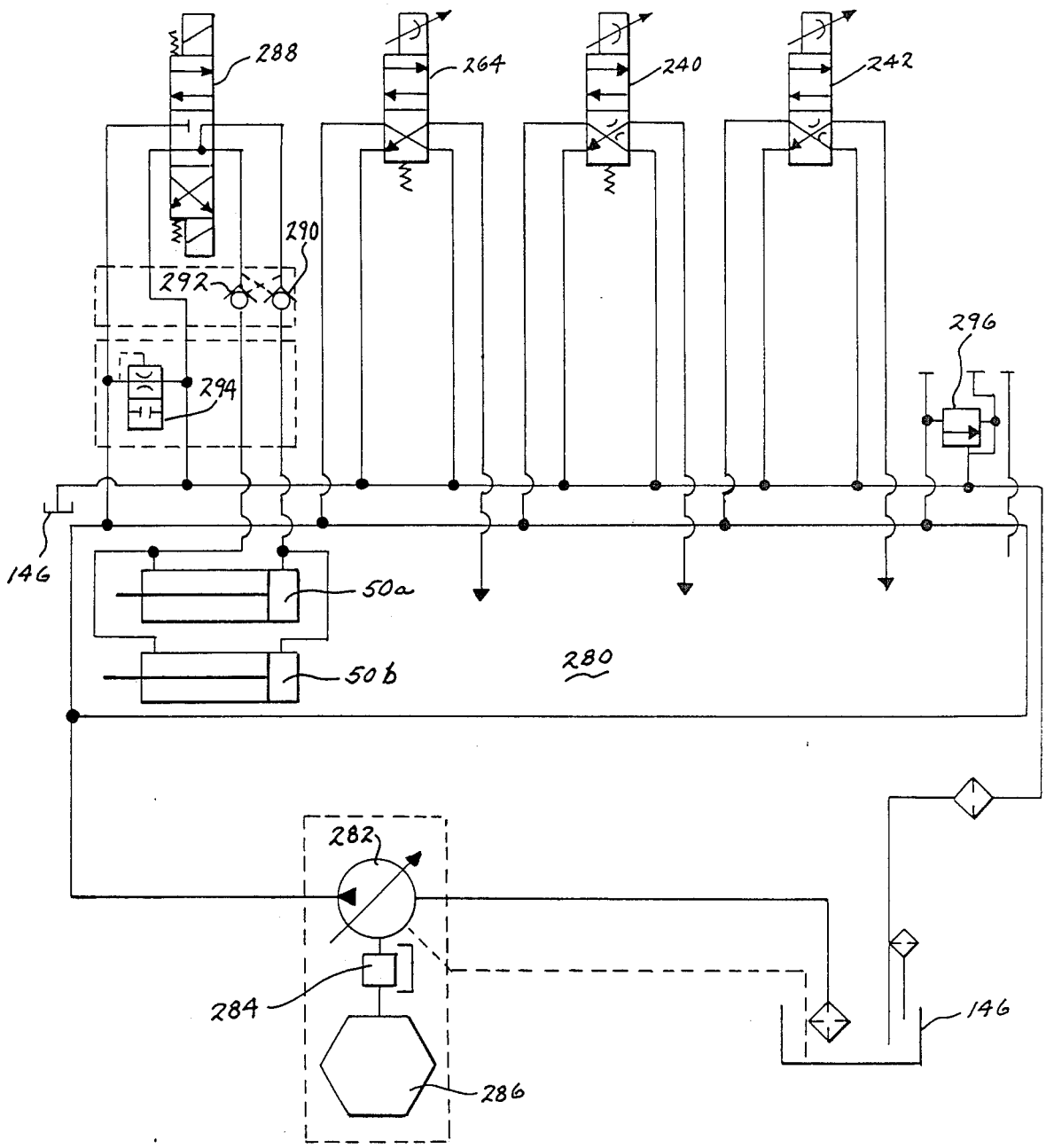

The retract ports of double acting vertical hydraulic columns 30 and 32 are connected through two way, solenoid operated, proportional control valve 264 to tank 146 and to the source of pressurized hydraulic fluid shown in FIG. 6C.

To extend vertical lifting columns 26 and 28, hydraulic fluid pump 22 provides hydraulic fluid through check valves 226 and 230 and valves 228 and 232 to the extend port at the base of the hydraulic lifting columns. Valves 228, 230, 234, and 238 are in the position shown in FIG. 6B. To control the extension of vertical lifting columns 26 and 28, hydraulic fluid is drawn off the vertical lifting columns from the retract ports through proportional control valves 240 and 242 to tank 146. When vertical lifting columns 26 and 28 have been extended by the desired amount, the supply of hydraulic fluid by pump 222 is stopped. The columns are held in the extended positions by the action of the check valve portions of control valves 228 and 232 and check valves 226 and 230.

To retract vertical lifting columns 26 and 28, valves 228, 232, 234, 236, 240, and 242 are actuated. Hydraulic fluid is supplied to the retract port through valves 240 and 242. Hydraulic fluid is removed from the inlet port of hydraulic lifting columns 26 and 28 through valves 228, 232, 234, and 236 to reservoir 146.

The operation of the circuitry for vertical hydraulic columns 30 and 32 proceeds in an analogous fashion.

FIG. 6C shows hydraulic circuitry 280 for booms 35 and 36. While as shown in FIGS. 1 and 2 this circuitry may be mounted on boom base members 38, 40, it will be appreciated it can be mounted elsewhere on mobile lifting apparatus 10. Hydraulic circuitry 280 includes hydraulic fluid pump 282. Pump 282 may be driven through coupling 284 from electric motor 286. Electric motor 286 may be powered by a generator driven by a prime power supply 144. Or, pump 282 may be driven directly from prime power supply 144. The output of pump 282 is provided to four way, three position, solenoid operated valve 288 and through pilot operated check valve 290 to one end of boom extension hydraulic cylinders 50*a* and 50*b*. The other ends of boom extension hydraulic cylinders 50*a* and 50*b* are connected through pilot operated check valve 292 and valve 288 to reservoir 146. Air bleed means 294 is connected across the supply and discharge lines of valve 288. The same is true of pressure relief valve 296.

Proportional control valves 240, 242, and 264, shown in FIG. 6B are repeated in FIG. 6C. It will be appreciated from FIG. 6C that each of the valves is provided with pressurized hydraulic fluid from pump 282, is connected to the pertinent hydraulic columns 26, 28, 30, or 32, and is connected to reservoir 146.

If hydraulic circuit 280 is coupled directly to prime power supply 144, it may be connected to hydraulic cylinders 50*a*, 50*b*, 26, 28, 30, and 32 by reel mounted hydraulic fuid hoses, and the like.

Figure 6D:
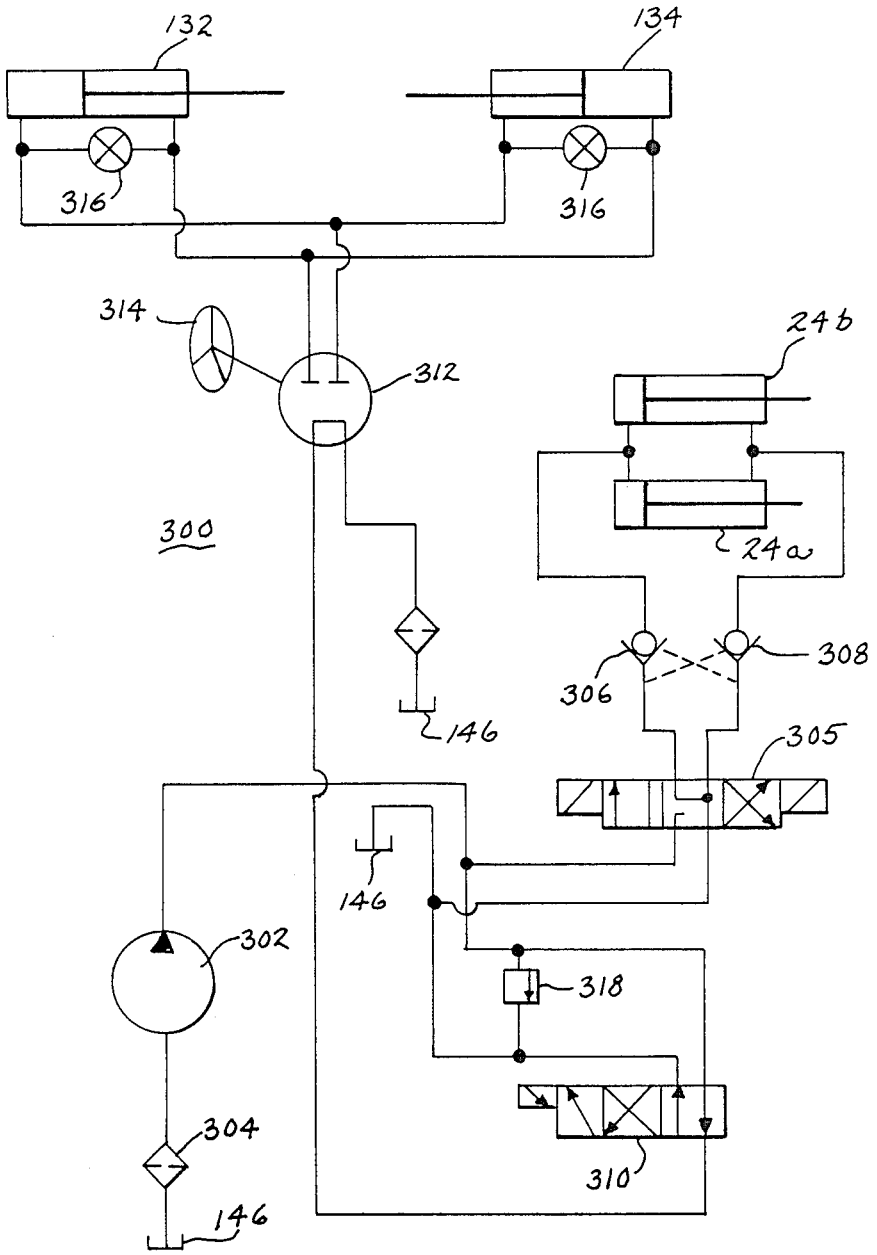

FIG. 6D shows hydraulic circuit 300 suitable for energizing the telescoping members of side frames 12 and 14 as well as the linear motors utilized to steer mobile lifting apparatus 10. Hydraulic circuit 300 includes hydraulic fluid pump 302 driven by prime power supply 144 and obtaining hydraulic fluid through filter 304 from tank 146. The output of hydraulic pump 302 is connected through four way, three position solenoid operated valve 305 and pilot operated check valves 306 and 308 to hydraulic cylinders 24*a* and 24*b* that extend and retract the telescoping members of the side frames and increase and decrease the wheelbase of mobile lifting apparatus 10. Valve 305 is also connected to tank 146.

The output of pump 302 is connected through solenoid operated control valve 310 to steering valve 312. Steering valve 312 is coupled to steering wheel 314 mounted in steering pedestal 152. The output of steering valve 312 is connected to hydraulic cylinders 132 and 134 that rotate pods 110A and 110B containing steering wheels 22. Steering valve 312 is also connected to tank 146. Needle valves 316 may be connected across cylinders 132 and 134. Pressure relief valve 318 is provided in the outlet of pump 302.

Figure 7:
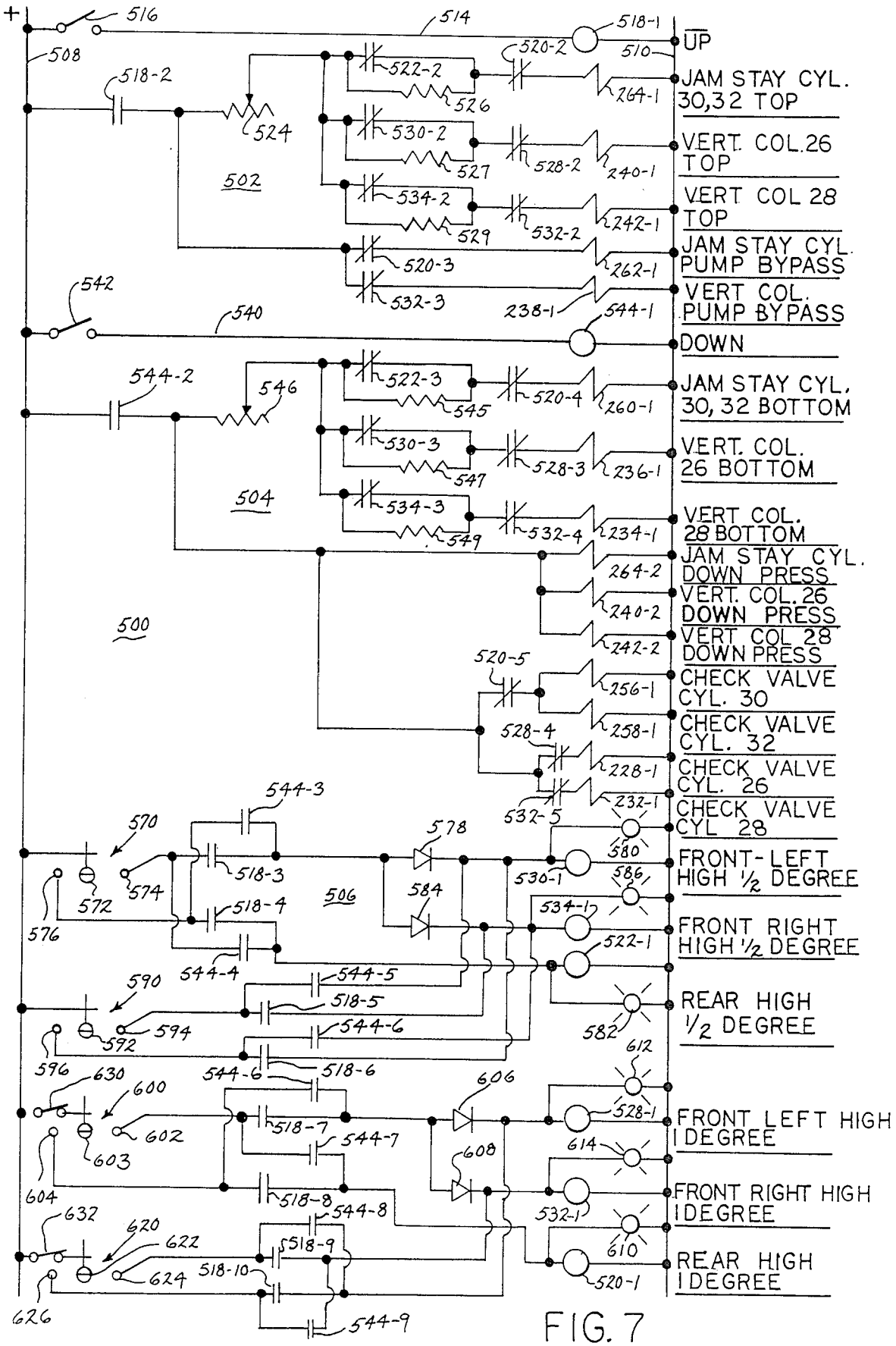
FIG. 7 is a schematic diagram of electrical circuitry for the mobile lifting apparatus.

FIG. 7 shows electrical circuitry 500 suitable for use in mobile lifting apparatus 10 to maintain booms 35, 36 and the associated assembly in a level condition as columns 26, 28, 30, and 32 are extended and retracted. Electrical circuitry 500 includes up control circuit 502, down control circuit 504, and level sensing circuit 506. Electrical circuitry 500 is energized by power buses 508 and 510.

Conductor 514 in up control circuit 502 includes up control switch 516 and relay coil 518-1. The solenoid coil 264-1 for control valve 264 shown in FIGS. 6B and 6C is connected to power bus 510. Control valve 264 is connected to the top of jam stay columns 30 and 32. Solenoid 264-1 coil controls the amount of fluid flow through valve 264 when the valve is in the condition shown in FIG. 6B. Solenoid coil 264-1 is connected through relay contacts 520-2, relay contacts 522-2, rheostat 524, and relay contacts 518-2 to power bus 508. Resistor 526 is connected across relay contacts 522-2.

The solenoid coil 240-1 for control valve 240 shown in FIGS. 6B and 6C is connected to power bus 510. Control valve 240 is connected to the top of vertical lifting column 26. Solenoid coil 240-1 controls the amount of fluid flow through valve 240 when the valve is in the condition shown in FIG. 6B. Solenoid coil 240-1 is connected through relay contacts 528-2, relay contacts 530-2, rheostat 524, and relay contacts 518-2 to power bus 508. Resistor 527 is connected across relay contacts 530-2.

The solenoid coil 242-1 for control valve 242 is connected to power bus 510. Control valve 242 is connected to the top of vertical lifting column 28. Solenoid coil 242-1 controls the amount of fluid flow through valve 242 when the valve is in the condition shown in FIG. 6B. Solenoid coil 242-1 is connected through relay contacts 532-2, relay contacts 534-2, rheostat 524, and relay contacts 518-2 to power bus 508. Resistor 529 is connected across relay contacts 534-2.

Solenoid coil 262-1 for bypass valve 260 for pump 250 is connected to power bus 510. Solenoid coil 262-1 is connected through relay contacts 520-3 and relay contacts 518-2 to power bus 508. Solenoid coil 238-1 for bypass valve 238 for pump 222 is connected to power bus 510 and through relay contacts 532-3 and 518-2 to power bus 508.

Conductor 540 in down control circuit includes down control switch 542 and relay coil 544-1. Solenoid coil 260-1 is connected to power bus 510. Solenoid coil 260-1 is connected through relay contacts 520-4, relay contacts 522-3, rheostat 546 and relay contacts 544-2 to power bus 508. Resistor 545 is connected across relay contacts 522-3.

Solenoid coil 236-1 for control valve 236 shown in FIGS. 6B and 6C is connected to power bus 510. Control valve 236 is connected to the bottom of vertical lifting column 26. Solenoid coil 236-1 is connected through relay contacts 528-3, relay contacts 530-3, rheostat 546, and relay contacts 544-2 to power bus 508. Relay contacts 530-3 are bridged by resistor 547.

Solenoid coil 234-1 for control valve 234 is connected to power bus 510. Control valve 234 is connected to the bottom of vertical lifting column 28. Solenoid coil 234-1 is connected through relay contacts 532-4, relay contacts 534-3, rheostat 546, and relay contacts 544-2 to power bus 508. Relay contacts 534-3 are bridged by resistor 549.

Solenoid coil 269-2 is connected to power bus 510 and through relay contacts 544-2 to power bus 508. Solenoid coil 264-2 operates valve 264 connected to the tops of jam stay columns 30–32, as shown in FIG. 6B to move the valve from one position to another.

Solenoid coil 240-2 is connected across power buses 508 and 510 through relay contacts 544-2. Control valve 240 operated between positions by solenoid coil 240-2 is connected to the top of vertical lifting column 26. Solenoid coil 242-2 is connected across power buses 508 and 510 through relay contacts 544-2. Control valve 242 operated between positions by solenoid coil 242-2 is connected to the top of vertical lifting column 28.

The solenoid coils 256-1 and 258-1 for check valves 256 and 258 connected to the bottoms of jam stay columns 30 and 32, respectively, are connected in parallel to power bus 510. The solenoid coils are connected through relay contacts 520-5 and relay contacts 542-2 to power bus 508.

The solenoid coils 228-1 and 232-1 for check valves 228 and 232 connected to the bottoms of vertical lifting columns 26 and 28 are connected in parallel to power bus 510. Solenoid coils 228-1 is connected through relay contacts 528-4 and 544-2 to power bus 508. Solenoid coil 232-1 is connected through relay contacts 532-5 and 544-2 to power bus 508.

Level sensing circuit 506 includes level sensor 570 responsive to the front to back tilt of the boom assembly 35–36 of mobile lifting apparatus 10. Level sensor 570 may contain pendulum 572 that engages contact 574 when the front of the boom assembly is half a degree or more higher than the rear of the boom assembly. Sensor 570 includes contact 576 engaged by pendulum 570 when the rear of the boom assembly is half a degree or more higher than the front of the boom assembly. Pendulum 572 is connected to power bus 508. Contact 574 is connected through relay contacts 518-3, diode 578, and relay coil 530-1 to power bus 510. Contact 576 is connected through relay contacts 518-4 and relay coil 522-1 to power bus 510. Relay coils 530-1 and 522-1 have parallel indicator lights 580 and 582, respectively. Relay contacts 544-3 connect contact 574 to relay coil 522-1. Relay contacts 544-3 connect contact 576 to relay coil 530-1. Diode 584 is connected in parallel with diode 578 and through relay coil 534-1 to power bus 510. Indicator light 586 is connected across relay coil 534-1.

Sensor 590 is similar to sensor 570 but detects side to side or left to right inclination of boom assembly 35–36. It includes pendulum 592 connected to power bus 508. Pendulum 592 engages contact 594 when the right side of the boom assembly is half a degree or more higher than the left side. Pendulum engages contacts 596 when the left side of boom assembly 35–36 is half a degree or more higher than the right side. Contact 594 is connected through relay contacts 518-5 to relay coil 534-1. Contact 594 is connected through relay contacts 544-6 to relay coil 534-1. Contact 596 is connected through relay contacts 544-5 to relay coil 530-1. Contact 596 is connected through relay contacts 518-6 to relay coil 530-1.

Sensor 600 is similar to sensors 570 and 590 except that pendulum 603 engages one of contacts 602 and 604 when the front to back tilt of boom assembly 35–36 is one degree or more. Contact 602 is connected through relay contacts 518-7 and diode 606 to relay coil 528-1 and power bus 510. Contact 604 is connected through relay contacts 518-8 and relay coil 520-1 to power bus 510. Diode 608 is connected in parallel with diode 606 and through relay coil 532-1 to power bus 510. Relay coils 520-1, 528-1, and 532-1 are bridged by indicator lights 610, 612, and 614, respectively. Relay contacts 544-7 connect contact 602 to relay coil 520-1. Contacts 544-6 connect contact 604 to relay coil 528-1.

Sensor 620 is similar to sensor 600 except that it measures side to side tilt of one degree or more. Pendulum 622 contacts contact 624 when the right side of boom assembly 35–36 is high and contact 626 when the left side of the boom assembly 35–36 is high. Contact 624 is connected through relay contacts 518-9 to relay coil 532-1. Contact 626 is connected through relay contacts 518-10 to relay coil 528-1. Relay contacts 544-8 connect contact 624 to relay coil 528-1. Relay contacts 544-9 connect contact 626 to relay coil 532-1.

In operation, mobile lifting apparatus 10 is driven to the site of the lift by front drive wheels 18. As noted above, when mobile lifting apparatus is unloaded, typically four driving wheels will be utilized, i.e. the inner and outer wheels **18*a* and 18*c* of each pod. Side beam members, such as member 12*a* shown in FIG. 2, are usually retracted to shorten the wheel base and permit mobile lifting apparatus 10** to be easily maneuvered within the confines of the work area.

The load is attached to booms 35 and 36 at one, or more of the rigging points by appropriate cables, slings, etc. Side frame members, such as member **12*a*, may be extended to increase the wheel base of the vehicle and move counterweight 142 away from the load. In a typical embodiment of the invention, the side frame members may be extended up to four feet. This increases both the capacity and stability of mobile lifting apparatus 10 in a highly desirable manner, particularly as contrasted to prior art apparatus in which only the counterweight is shifted. The weight of counterweight 142 may be increased or decreased by adding or removing weights 142*a***.

Hydraulic columns 26 and 28 forming the vertical mast and jam stay hydraulic columns 30 and 32 are then raised to lift the load. It will be appreciated that the main lifting force is exerted by front hydraulic columns 26 and 28, while jam stay columns 30 and 32 provide a downward holding, or jamming, force that stabilizes the booms and maintains them in the desired position. The ordinary manufacturing tolerances for hydraulic cylinders of columns 26, 28, 30, 32 are such that even if normal leaks occur, significant movement will not develop in the columns for a period of an hour or more. Valve 264 connected to the retract ports of jam stay columns 30 and 32 may block the flow of fluid from the retract ports, thereby preventing the extension of the cylinders and maintaining the downward holding force.

Jam stay columns 30, 32 may be raised or lowered to permit booms 34 and 36 to tilt by rotation about the upper ends of the vertical mast hydraulic columns 26, 28. This facilitates positioning of the load.

By means of the circuitry shown in FIG. 7, it is also possible to provide automatic leveling of boom assembly 35–36 so as to maintain the boom assembly horizontal as it is raised and lowered. The automatic leveling is accomplished by sensing when boom assembly is out of the level condition in either the front to rear direction or side to side direction by sensors 570, 590, 600, and 620. The volume of hydraulic fluid leaving the cylinder or cylinders which are highest in elevation is then reduced to reduce its movement and bring boom assembly 35–36 into the level condition. Automatic leveling is achieved during both the extension of the cylinders and the retraction of the cylinders.

To provide automatic leveling when the cylinders are being extended, switch 516 is closed energizing relay 518. This in turn energizes control solenoids 238-1 and 262-1 and valves 238 and 262. Energizing relay 518 also energizes control solenoids 240-1, 242-1, and 264-1 of valves 240, 242, and 246 connected to the tops of vertical lifting columns 26 and 28 and jam stay columns 30 and 32. By adjusting rheostat 524, the voltage provided to control solenoids 240-1, 242-1, and 264-1 may be controlled to control the volume of hydraulic fluid leaving the cylinders and the rate of extension.

Should vertical lifting columns 26 and 28 extend at a faster rate than jam stay columns 30, 32, sensor 570 would be operated so that pendulum 572 engage contact 574 when the amount of tilt exceeds one half degree from the horizontal. This would energize relays 530 and 534 opening relay contacts 530-2 and 534. This places resistors 527 and 529 in the circuit, reducing the voltage to solenoid coils 240-1 and 240-2, thereby reducing the volume of hydraulic fluid leaving vertical columns 26 and 28 and restoring boom assembly 35–36 to the level condition.

Should the two jam stay columns 30, 32 extend at a faster rate than vertical lifting columns 26 and 28, pendulum 572 will engage contact 576. This will energize relay coil 522-1, opening relay contacts 522-2 and placing resistor 526 in series with solenoid coil 264-1. The amount of fluid leaving jam stay columns 30, 32 is reduced, thereby restoring boom assembly 35-36 to the level condition, and the rate of extension is reduced.

Side to side levelling utilizing sensor 590 operates in a generally analogous manner.

Should the relative cylinder extension rate differ to such an extent as to cause boom assembly 35-36 to tilt by an amount of one degree or more from the level, sensors 600 and 620 are utilized. For example, if boom assembly 35-36 tilts from front to back with the front high by one degree or more, pendulum 603 engages contact 602. Relay coils 528-1 and 532-1 are energized. This opens relay contacts 528-2 and 532-2, deenergizing solenoid coils 240-1 and 242-1. This blocks all flow from the vertical lifting columns and movement of the column until such time as boom assembly 35-36 comes within one half degree of level, at which time the sensor 570 assumes the leveling function.

An analogous operation occurs if boom assembly 35-36 is out of level in the side by side direction by more than one degree.

Levelling when boom assembly 35-36 is being lowered is accomplished in a similar manner. The cylinder or cylinders descending at the faster rate are retarded or stopped in order to level boom assembly 35-36. It may be desired to override the levelling circuit so as to permit boom assembly 35-36 to tilt, for example to avoid obstructions. This may be accomplished by switches 630 and 632 associated with 10 sensors 600 and 620 that deenergize the sensors.

In the typical embodiment of the invention shown in the figures, loads of up to 50 tons can be raised up to 24 feet, with four stage lift and jam stay cylinders.

After the load is lifted, mobile lifting apparatus 10 may be moved by driving wheels 18 and steering wheels 22. As noted above, typically only two driving wheels, one in each pod, would be employed when mobile lifting apparatus 10 is under load. The hydraulic cylinders of columns 26, 28, 30 and 32 are retracted to lower the load when the transport is complete.

Various modes of carrying out the invention are contemplated as being within the scope of the following claims particularly pointing out and distinctly claiming the subject matter which is regarded as the invention.

I claim:

1. A mobile load handling apparatus for lifting, lowering, or positioning a load comprising:

a chassis having driving wheel means for propelling said apparatus and steerable wheel means for steering said apparatus;

vertical mast means mounted on the front of said chassis, said vertical mast means comprising a pair of extendable means mounted at their bottoms on said chassis, said extendable means being horizontally spaced normal to the direction of travel of said apparatus;

jam stay means mounted on said chassis rearwardly of said vertical mast means, said jam means comprising vertically extendable means mounted at its bottom on said chassis;

boom means coupled to the tops of said vertical mast means and jam means, said boom means having a pair of extendable booms for increasing the length of said boom means beyond said chassis in a direction parallel to the direction of travel of the apparatus, said boom means having means for engaging the load to be handled beyond said chassis; and power means for powering said driving wheel means and extending and retracting said vertical mast means, jam stay means, and booms, said vertical mast means being extendable to raise said boom means and lift the load, said jam stay means being extendable coordinately with said vertical mast means to permit said boom means to be raised while exerting a downward force on said boom means opposing that of the load.

2. The mobile load handling apparatus according to claim 1 wherein said vertical mast means comprises a pair of extendable cylinder means.

3. The mobile load handling apparatus according to claim 2 wherein said cylinder means is further defined as hydraulic cylinder means.

4. The mobile load handling apparatus according to claim 1 further including protective means for said vertical mast means.

5. The mobile load handling apparatus according to claim 1 wherein said jam stay means comprises at least one extendable cylinder means.

6. The mobile load handling apparatus according to claim 5 wherein said jam stay means comprises a pair of cylinder means.

7. The mobile load handling apparatus according to claim 6 wherein said jam stay means comprises an adjacent pair of cylinders.

8. The mobile load handling apparatus according to claim 5 wherein said extendable cylinder means is further defined as double acting hydraulic cylinder means.

9. The mobile load handling apparatus according to claim 1 wherein said vertical mast means and jam stay means support said boom means at substantially three points.

10. The mobile load handling apparatus according to claim 1 wherein said boom means includes a pair of spaced apart boom base members coupled to said vertical mast means and jam stay means, said boom base members having said extendable booms telescopically mounted therein.

11. The mobile load handling apparatus according to claim 1 further including a transverse member joining the ends of said extendable booms.

12. The mobile load handling apparatus according to claim 1 further including means for engaging the load adjustably mounted on said booms.

13. The mobile load handling apparatus according to claim 1 wherein said driving wheel means is mounted on the front of said chassis.

14. The mobile load handling apparatus according to claim 1 wherein said driving wheel means includes at least a pair of driving wheels.

15. The mobile load handling apparatus according to claim 1 wherein said driving wheel means is further defined as including at least two pairs of driving wheels, said mobile lifting apparatus further including means for selectively driving one or both of said wheels of said pairs.

16. The mobile load handling apparatus according to claim 15 and further including idler wheels mounted intermediate said wheels of said pairs.

17. The mobile load handling apparatus according to claim 14 wherein said driving wheels are mounted on shafts spacedly supported along their lengths by bearings in said chassis.

18. The mobile load handling apparatus according to claim 1 wherein said steerable wheel means is mounted on the rear of said chassis.

19. The mobile load handling apparatus according to claim 18 wherein said steerable wheel means includes at least two steerable wheels spaced in a direction normal to the direction of travel of said apparatus.

20. The mobile load handling apparatus according to claim 19 further including two pairs of steerable wheels.

21. The mobile load handling apparatus according to claim 1 wherein said steerable wheel means is mounted in at least one pod mounted in an annular bearing on said chassis for rotation about a vertical axis.

22. The mobile load handling apparatus according to claim 19 wherein each of said steerable wheels is mounted in a pod mounted on an annular bearing on said chassis for rotation about a vertical axis.

23. The mobile load handling apparatus according to claim 19 wherein said steerable wheels are mounted in said chassis for rotation about a vertical axis, said mobile lifting apparatus including steering means comprising linear motor means extending between each of said steerable wheels and said chassis for rotating said wheels, and including a tie rod extending between said wheels, said linear motors being operable by said power means.

24. The mobile load handling apparatus according to claim 19 wherein said steerable wheels includes two pairs of steerable wheels, the wheels of each pair being mounted on an shaft spacedly supported along its length.

25. The mobile load handling apparatus according to claim 1, wherein said chassis is rearwardly extendable and retractable for altering the wheel base of said chassis.

26. The mobile load handling apparatus according to claim 25 wherein said power means further includes means for extending and retracting said chassis.

27. The mobile load handling apparatus according to claim 25 wherein said chassis includes a pair of spaced, telescoping side members for extending and retracting said chassis.

28. The mobile load handling apparatus according to claim 25 wherein said steerable wheel means is mounted on a portion of the chassis that is rearwardly extendable and retractable.

29. The mobile load handling apparatus according to claim 1 wherein said chassis includes a counterweight on the rear thereof.

30. The mobile load handling apparatus according to claim 29 wherein said counterweight is a modular counterweight.

31. The mobile load handling apparatus according to claim 30 wherein said counterweight includes means for interlocking the modular portions of the counterweight together.

32. The mobile load handling apparatus according to claim 28 wherein said chassis includes a counterweight on a rearwardly extendable and retractable portion thereof supported by said steerable wheel means.

33. The mobile load handling apparatus according to claim 32 wherein said counterweight is a modular counterweight.

34. The mobile load handling apparatus according to claim 1 wherein said power means comprises hydraulic power means.

35. The mobile load handling apparatus according to claim 34 wherein said power means includes electrically operated, hydraulic power means.

36. The mobile load handling apparatus according to claim 1 wherein said power means includes means for coordinately operating said vertical mast means and jam stay means for maintaining said boom means in a desired orientation.

37. The mobile load handling apparatus according to claim 36 wherein said power means includes means for coordinately operating said vertical mast means and jam stay means for maintaining said boom means in a level orientation.

38. The mobile load handling apparatus according to claim 1 wherein said driving wheel means includes at least a pair of driving wheels spaced in a direction normal to the direction of travel of said apparatus, wherein said power means comprises hydraulic power means, and wherein said power means includes a pair of hydraulic motors for driving said driving wheels, said motors being connected in parallel with a hydraulic pump for providing differential driving of said wheels when said apparatus is steered.

39. The mobile load handling apparatus according to claim 1 wherein said vertical mast means and jam stay means comprise hydraulic cylinder means having areas, transverse to the direction of extension, on which hydraulic forces are applied in operating the hydraulic cylinder means, said area of said jam stay means hydraulic cylinder means being greater than said area of said vertical mast means hydraulic cylinder means for insuring that said downward force is exertable on said boom means.

* * * * *